US006010429A

United States Patent [19]

Prueitt

[11] Patent Number: 6,010,429

[45] Date of Patent: Jan. 4, 2000

[54] INTERACTIVE AEROBIC EXERCISE MACHINE

[76] Inventor: Daniel S. Prueitt, 8492 S. Wadsworth Ct., Littleton, Colo. 80128

[21] Appl. No.: 08/902,243

[22] Filed: Jul. 29, 1997

[51] Int. Cl.[7] ..... A63B 5/22

[52] U.S. Cl. ..... 482/4; 482/81; 482/82

[58] Field of Search ..... 482/1–5, 81, 82, 482/148

[56] References Cited

U.S. PATENT DOCUMENTS 4,813,665 3/1989 Carr ..... 482/81

5,464,376 11/1995 Weston et al. ..... 482/81

*Primary Examiner*—Glenn E. Richman

*Attorney, Agent, or Firm*—Ray G. Wilson

[57] ABSTRACT

An interactive aerobic exercise machine has a support frame assembly with two parallel, spaced apart vertical frames, an obstacle rod rotatably mounted on each vertical frame, and a motor for rotating each obstacle rod at selected rotation speeds. The rotating obstacle rods allow a user to exercise a variety of different muscles while the user is also developing depth perception, timing, reaction, agility, coordination, and aerobic fitness. In a particular embodiment, each motor is slidably mounted on the vertical frame for vertically positioning the obstacle rods at a variety of vertical locations. The machine may further include a crank rod connected to the motor and a pivot block assembly connecting the crank rod to the obstacle rod, where the pivot block assembly permits the obstacle rod to move in any direction in response to encountering an obstacle to prevent injury to a user. The pivot block may also include an electrical switch for generating an output signal when the pivot block acts to permit movement of the obstacle rod.

10 Claims, 9 Drawing Sheets

INTERACTIVE AEROBIC EXERCISE MACHINE

This invention is described in Disclosure Document No. 404,818, filed Sep. 9, 1996.

BACKGROUND OF THE INVENTION

This invention relates to aerobic exercise machines, and, more particularly, to aerobic exercise machines having variable characteristics to provide an interactive workout.

Many different types of aerobic exercise machines are known. There are treadmills for walking or running to develop aerobic endurance. Stair-step devices provide an aerobic workout along with leg strength development. Rowing machines develop a variety of muscles while providing an aerobic workout.

But these devices are basically boring to use. There is little mental exercise that is or can be done when using one of these known machines. There is a need for an exercise machine that will provide not only strength and aerobic conditioning, but will also improve agility and reaction time, requiring rapid mental analysis and decision making while encountering a variety of obstacles.

The present invention is directed to this problem and an interactive aerobic exercise machine is provided to present a changing set of obstacles to the user that require such activities as crawling, ducking under, jumping over, somersaulting, swinging, and other manuevers to avoid a set of moving obstacles.

Accordingly, one object of the present invention is to require rapid decision making on the timing and manuevers needed to move through the moving obstacles.

It is another object of the present invention to provide obstacle features that can be varied from workout to workout to provide a continuous challenge.

Yet another object of the present invention is to provide a set of moving obstacles that can safely interact with the user if the user misjudges the movement of the obstacles.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise an interactive aerobic exercise machine having a support frame assembly with two parallel, spaced apart vertical frames, an obstacle rod rotatably mounted on each vertical frame, and a motor for rotating each obstacle rod at selected rotation speeds. In a particular embodiment, each motor is slidably mounted on the vertical frame for vertically positioning the obstacle rods at a variety of vertical locations. The machine may further include a crank rod connected to the motor and a pivot block assembly connecting the crank rod to the obstacle rod, where the pivot block assembly permits the obstacle rod to move in any direction in response to encountering an obstacle to prevent injury to a user. The pivot block may also include an electrical switch for generating an output signal when the pivot block acts to permit movement of the obstacle rod.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Figure 1A:
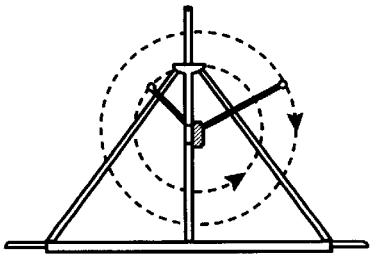
FIGS. 1A–C illustrate various configurations and movements of rotating obstacle rods according to one embodiment of the present invention.
Figure 1B:
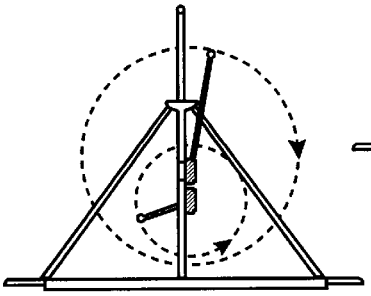
Figure 1C:
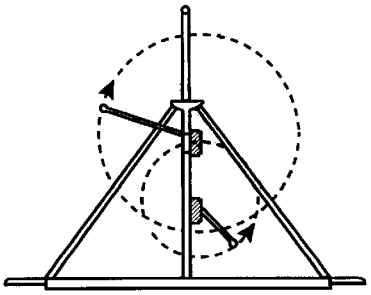

FIGS. 1A–1C illustrate various relative movements of rotating obstacle rods 10, 10' according to the present invention. The interactive aerobic exercise machine is designed to exercise a variety of different muscles while the user is also developing depth perception, timing, reaction time, agility, coordination, and aerobic fitness. The machine can be used with either one or two rotating obstacle rods 10, 10', where one rod is employed for a novice and two rods are employed for an advanced user where rods 10 and 10' rotate in opposite directions.

Figure 2A:
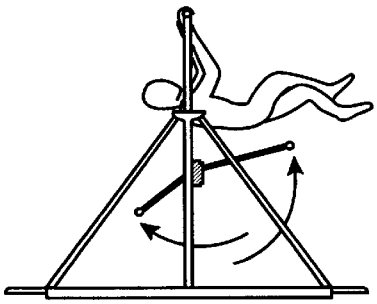
FIGS. 2A–E pictorially depict various forms of interaction between the rotating obstacle rods and a user of the machine.
Figure 2B:
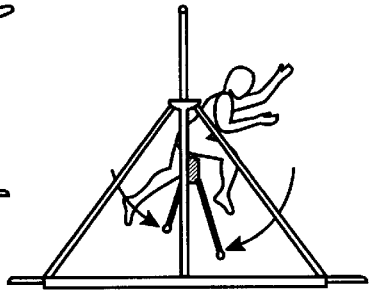
Figure 2C:
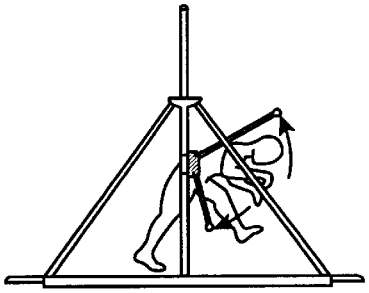
Figure 2D:
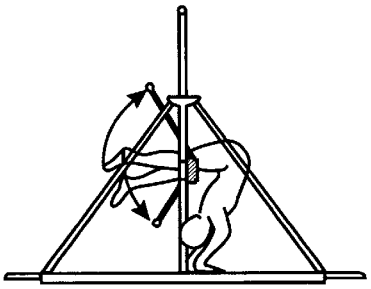
Figure 2E:
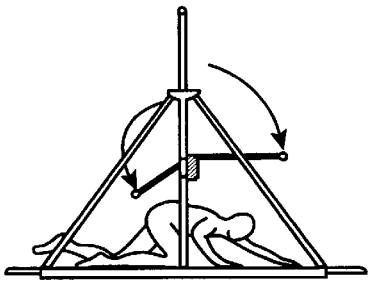

Exercise is done by a user moving back and forth through the machine, as shown by exemplary movements in FIGS. 2A–2E. Exemplary movements may comprise swinging over the rotating obstacle rods 10 10' (FIG. 2A), jumping over the rods 10 10' (FIG. 2B), a combination of stepping and ducking (FIG. 2C), somersaulting over the rods 10 10' (FIG. 2D), or crawling beneath the rotating rods 10 10' (FIG. 2E). In one embodiment, described below, a sensing exercise mat is provided to monitor movement and timing of the user in order to measure performance. The user must make decisions about the speed and relative timing of the rotating obstacle rods and determine a strategy to move through the rods. It will also be appreciated that the height of the rods and the crank radius can be varied as well as the speed of rotation and the height of a horizontal bar used to swing over the rods. Thus, the user can encounter an ever-changing set of obstacles to overcome.

Figure 3:
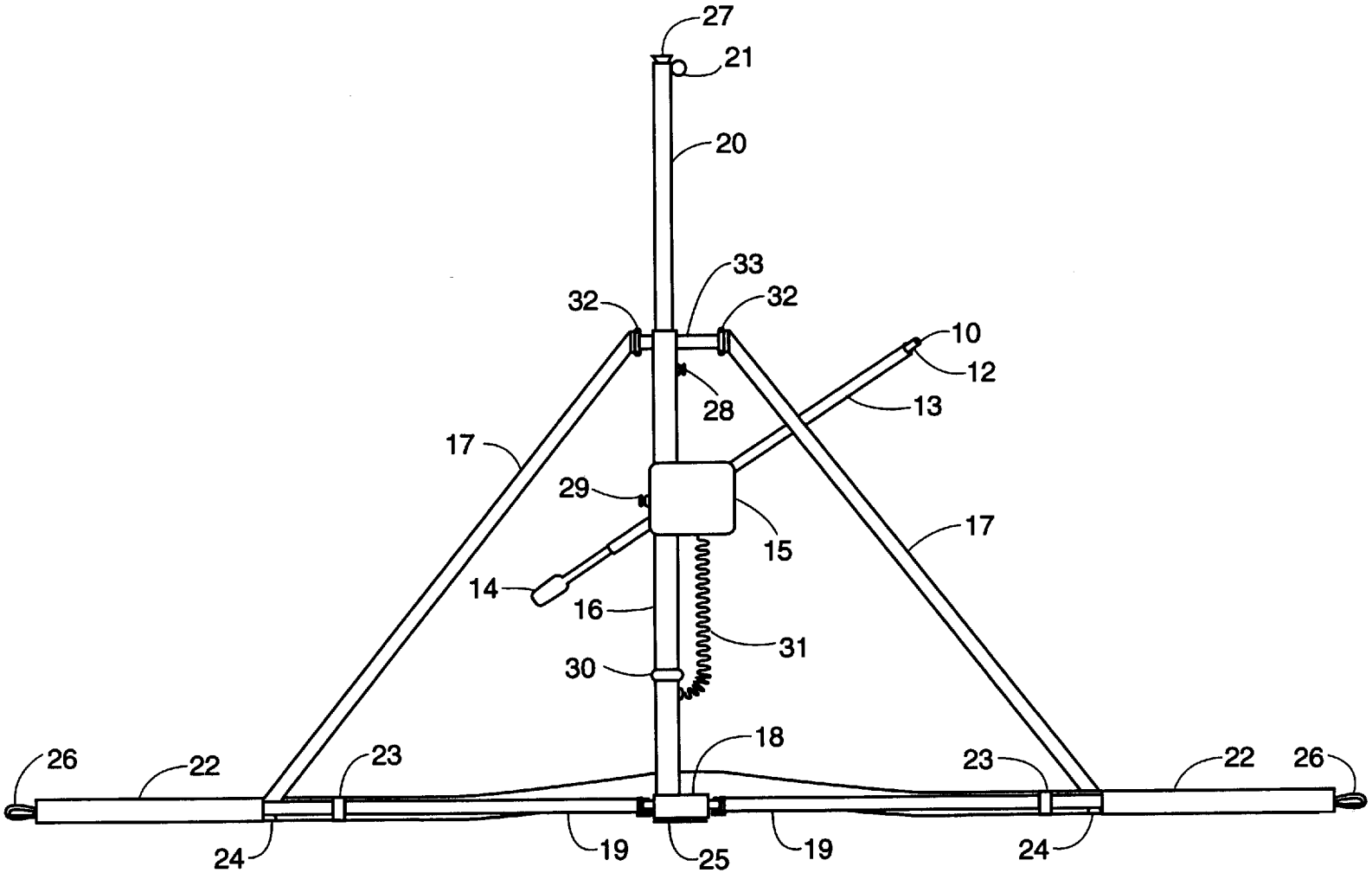
FIG. 3 is a side view of a pictorial illustration of one embodiment of an interactive exercise machine according to the present invention.
Figure 4:
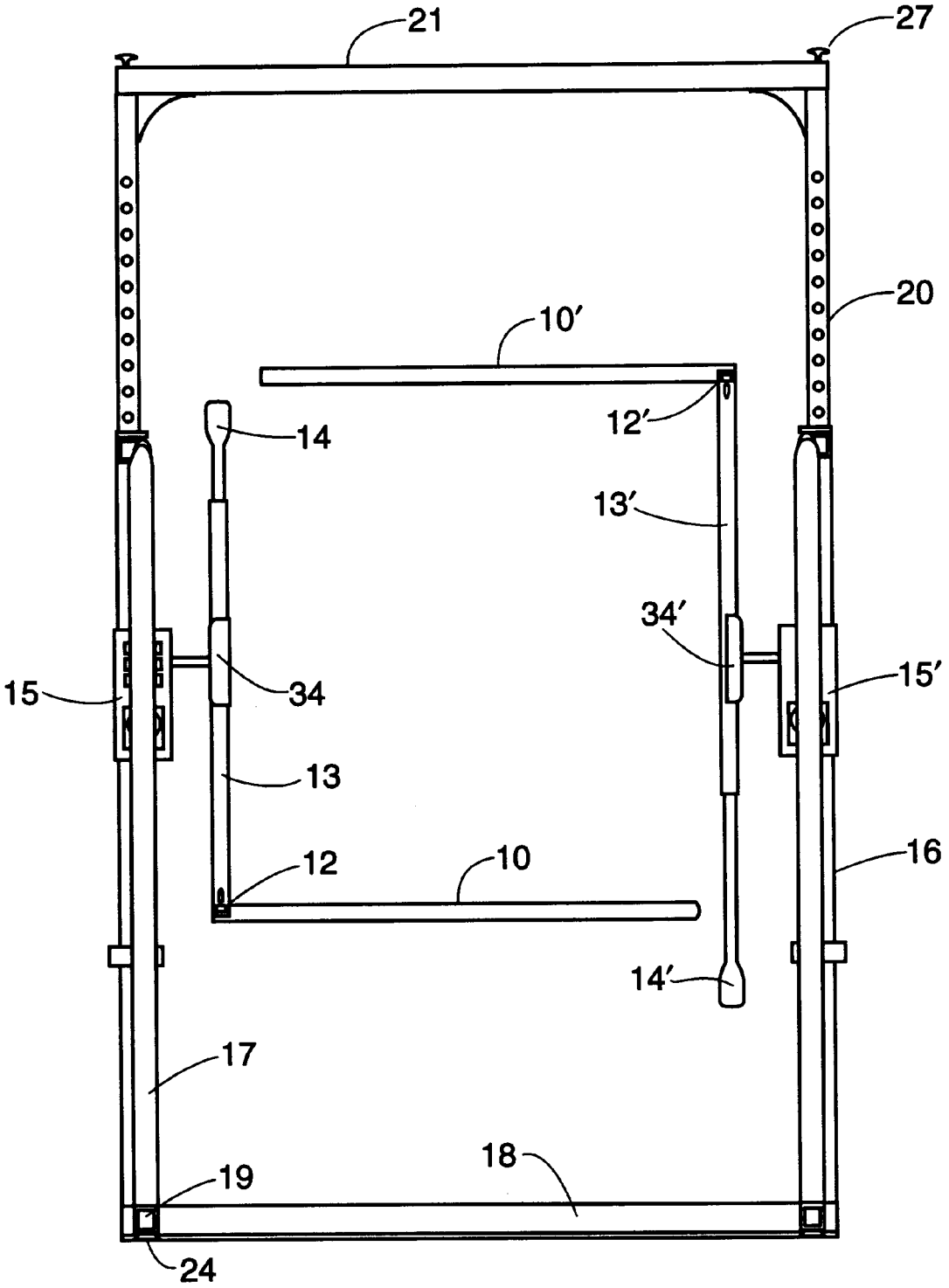
FIG. 4 is an end view of the machine shown in FIG. 3.

FIG. 3 is a side view of an interactive aerobic exercise machine according to one embodiment of the present invention. In the figures and in the following discussion, identical parts have the same reference number and may not be discussed for each figure. Primed numbers denote identical parts in the same figure and reference to the unprimed number includes reference to the prime number. The primary interactive obstacle in the machine is rotating obstacle rod 10 that is connected to crank 13 by pivot block 12. As shown in FIG. 4, obstacle rod 10 depends from crank 13 to form an "L" shaped obstacle rod assembly. Obstacle rod 10 and crank 13 are balanced about motor housing 15 by adjustable counterweight 14. The assembly of obstacle rod 10, crank 13, and motor housing 15 are slidably mounted on vertical support 16 and clamped to vertical support 16 through, e.g., screw clamp 29. Stop 30 limits downward movement of the motor crank assembly. Flexible power cord 31 provides power to the enclosed motor throughout vertical movement of the motor crank assembly.

Vertical support 16 is supported by a stable frame comprising legs 19 and diagonal support 17 that are connected to vertical support 16 by hinged base element 18 and hinges 32 on hinge extension 33. Base element 18 preferably includes non-skid pad 25 to prevent machine movement during an exercise routine. Legs 19 may further include feet 24 for leveling and supporting the machine. An exercise mat 22, further discussed below, is placed between legs 19 and preferably includes stabilizer bars 23 that hook over legs 19 to keep legs 19 from moving from side-to-side. Mat loop cords 26 are provided for mat storage and may be looped over loop holders 27 at the top of risers 20.

Another element of the machine is horizontal bar 21 that is fixed to riser 20. Riser 20 is sized to slide within vertical support 16 and clamp to vertical support 16 at a selected vertical height. Thumbscrew 28 provides an exemplary clamp, but any number of suitable clamping arrangements may be provided.

Referring now to FIG. 4, there is seen an end view of the interactive aerobic exercise machine. Horizontal bar 21 is elevated on risers 20. Legs 19 (FIG. 3) and diagonal supports 17 swing about hinges on base 18 and hinges 32, 33, respectively, to become parallel to base 18 so that the folded unit is essentially planar for storage.

Figure 5:
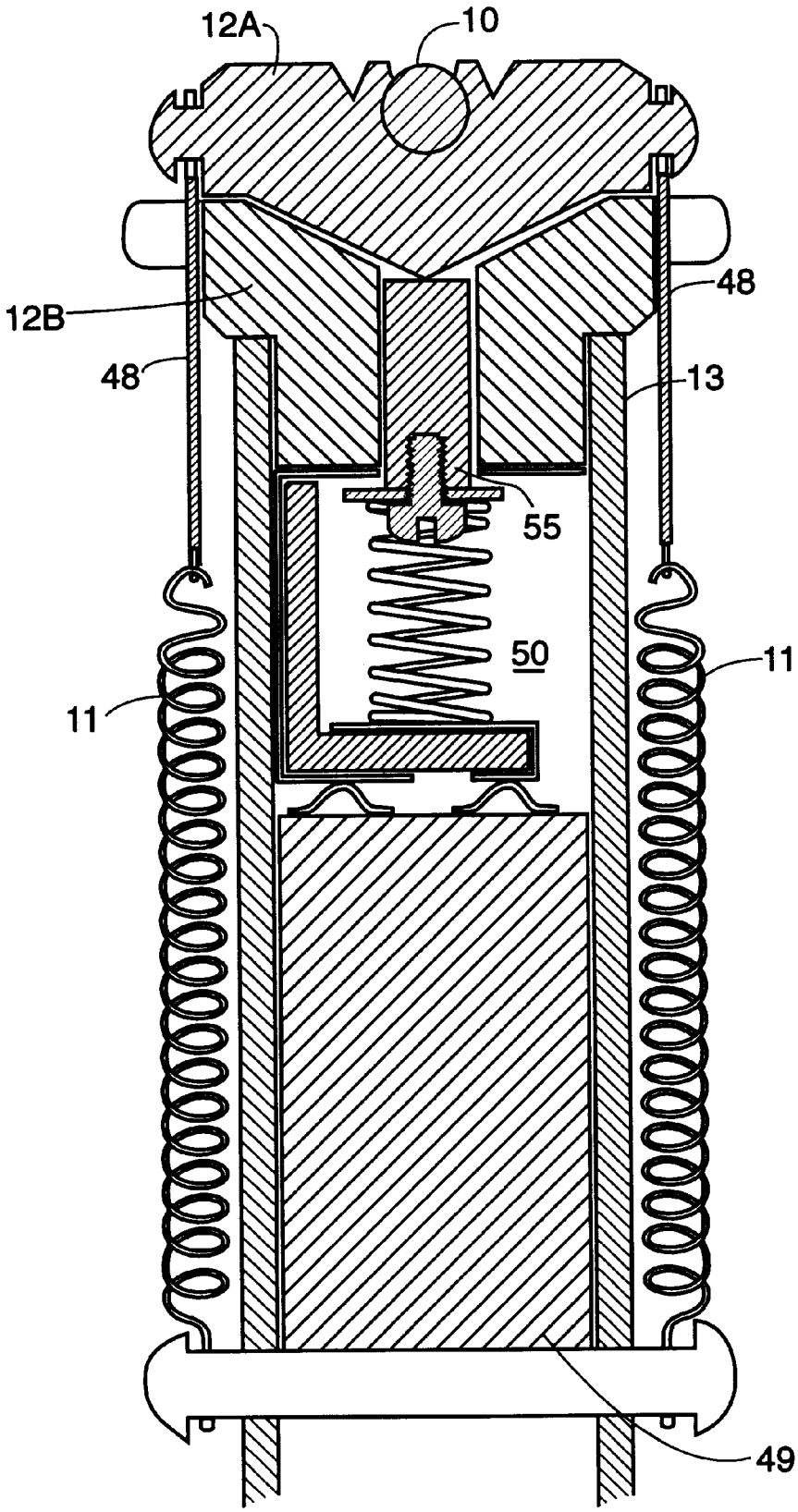
FIG. 5 is a side view in partial cross-section of a resetting pivot block safety release for the obstacle rods.

Referring now to FIG. 5, the rotating obstacle rods 10 are shown mounted on crank rod 13. Rods 10 are mounted to run horizontally between vertical supports 16 (FIG. 3). In one embodiment, rods 10 are formed from a tapered fiber glass rod that is covered in foam padding to minimize any injury from impact with a user. To further minimize the chance for injury, rod 10 is connected to pivot block 12 that enables rod 10 to move in any direction when obstructed. Pivot block 12 is mounted at one end of crank 13 and includes bottom wedge block 12B within crank 13 and top wedge block 12A that is resiliently held within bottom wedge block 12B. In one embodiment, top wedge block 12A is urged within bottom wedge block 12B; by tension springs 11 and tension cables 48 so that suitable torsion forces or tension forces are generated to return top wedge block 12A to within bottom wedge block 12B once force is removed from obstacle rod 10.

In one embodiment, the interactive aerobic exercise machine keeps track of contacts between obstacle rods 10 and a user. Then pivot block 12 may include error switch 50 and data transmitter 49. When top pivot block 12A is dislodged by obstacle rod 10 contacting a user, plunger 55 moves upwardly to complete a circuit connected to transmitter 49. Each time the circuit is completed, transmitter 49 transmits a pulse to a receiver, discussed below, that keeps score.

Figure 6:
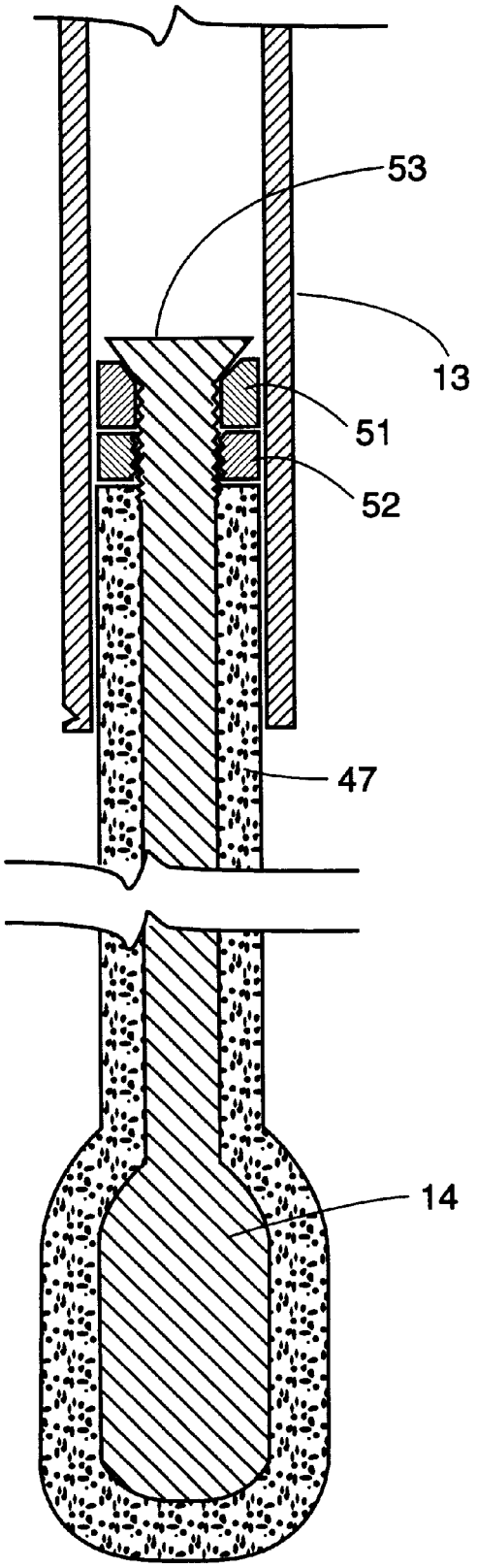
FIG. 6 is a cross-section of a variable counterweight for use with the variable obstacle rods of the present invention.

At the other end from pivot block 12, on crank 13 is mounted counter balance 14, shown in FIG. 6, having a weight to balance the load on the motor that rotates crank 13 to enable a constant motor speed irrespective of the position of obstacle rod 10 (FIGS. 3, 4, 5). Counter balance 14 may be covered by a foam padding 47 for safety reasons and is held within crank 13 by expanding rubber bushing 51 when compressed between nut 52 and bolt head 53. Bolt head 53 may be rotated to decompress bushing 51 for repositioning counter weight 14 within crank 13.

Figure 7:
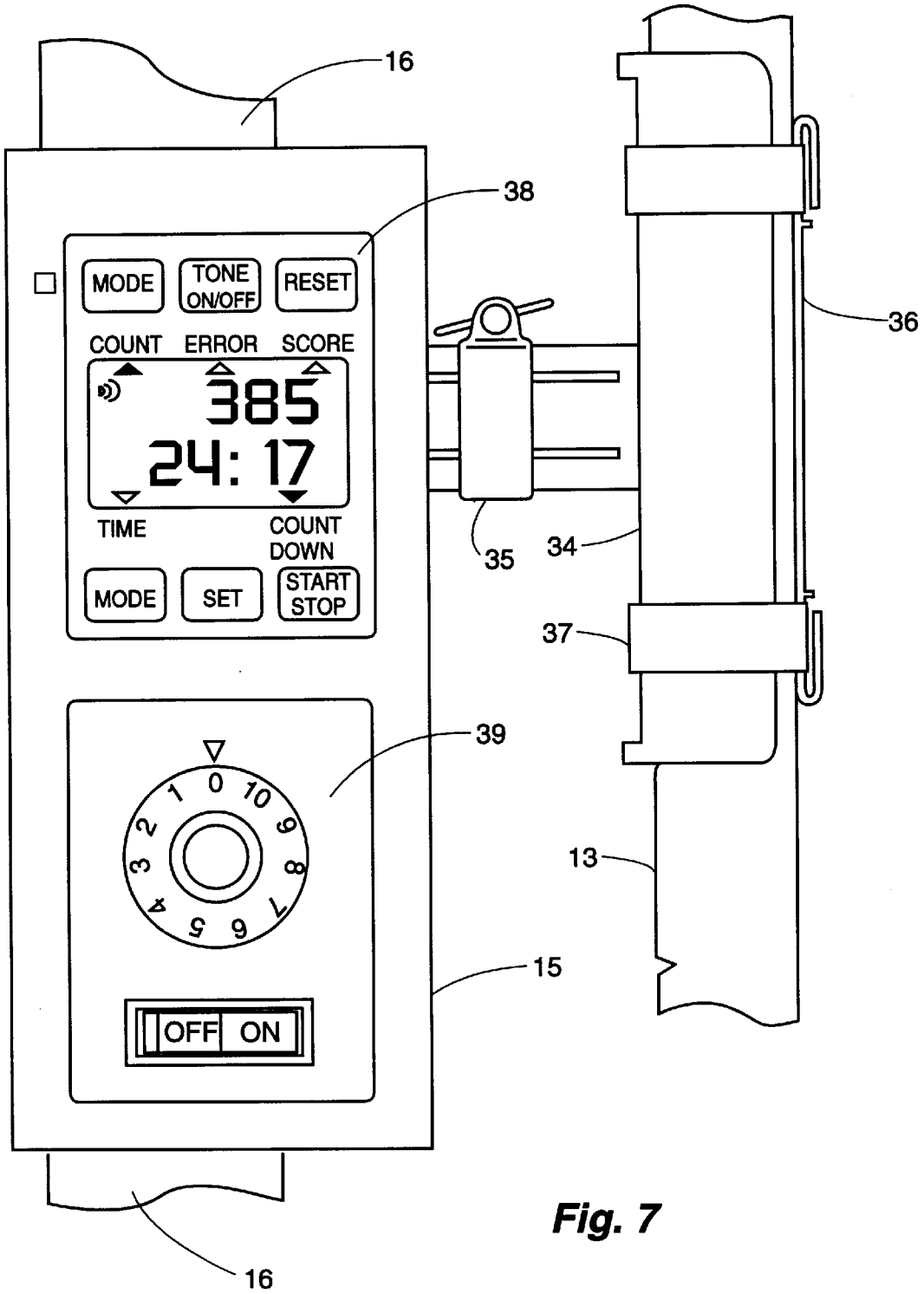
FIG. 7 is a pictorial illustration of a control unit according to one embodiment of the present invention
Figures 8A, 8B:
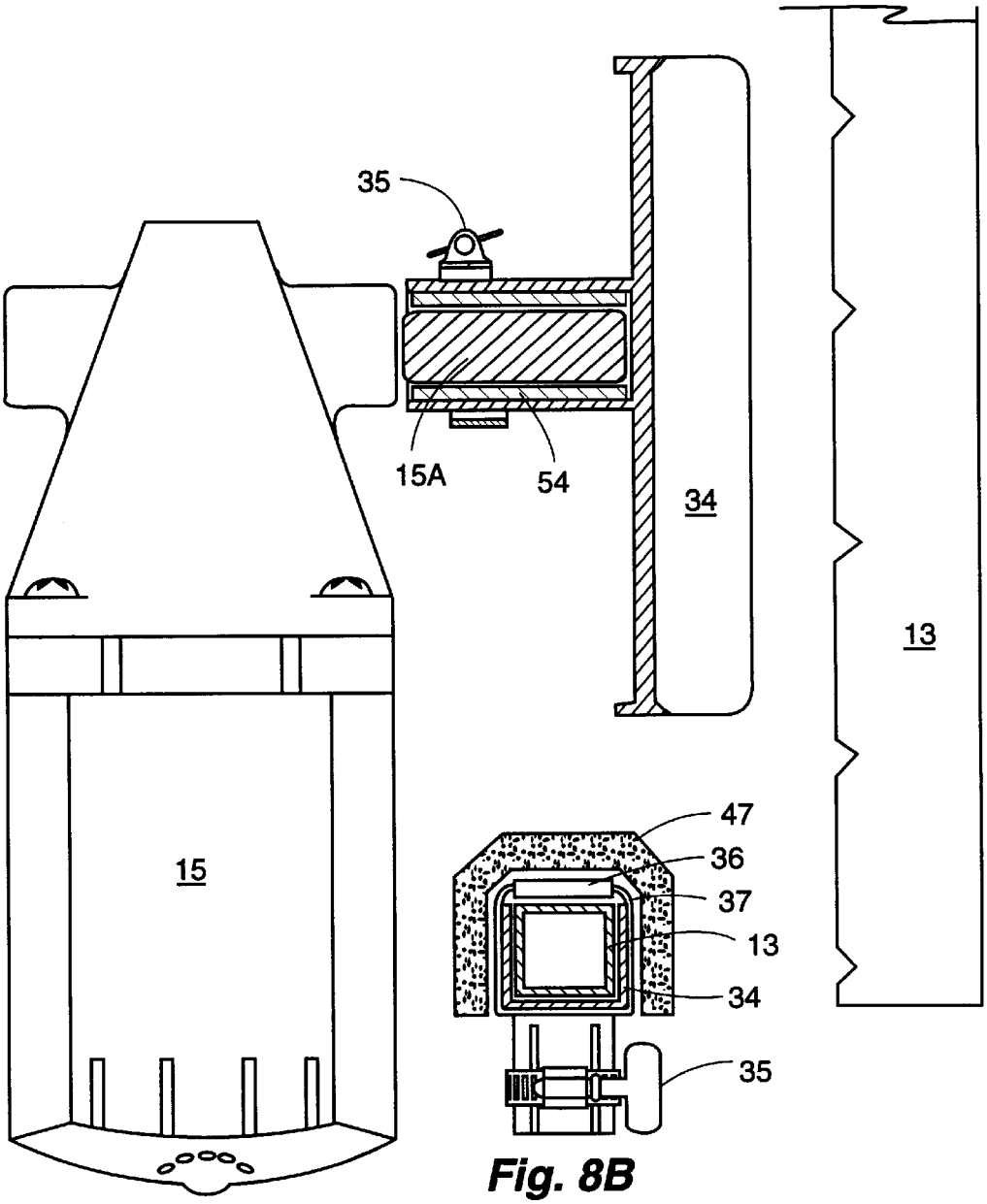
FIGS. 8A–B are pictorial illustrations in partial cross-section of a sliding motor mounting and adjustable torque control for operating the obstacle rods.

Referring now to FIGS. 7, 8A, and 8B, it will be seen that crank 13 is attached to crank bracket 34 by the action of elastic bands 37 that clamp crank 13 between bracket 34 and a skid 36. V-shaped protrusions are provided at each end of bracket 34 that mate with V-notches in crank 13 to lock crank 13 in place within bracket 34. A plurality of V-notches permit crank 13 to be repositioned within crank bracket 34. The action of the V-notches, elastic bands 37, and skid 36 act to protect users and the motor from damage if the user interferes with movement of crank 13. Skid 36 allows for smoother sliding operation when adjusting the length of crank 13. Crank bracket 34 is connected, in turn, to shaft 15A of motor 15 by the action of clamp 35 on friction bushing 54. Clamp 35 can be adjusted so that bushing 54 acts as, a slip clutch to protect motor 15 from excessive torque arising from binding of crank 13.

FIG. 8B more particularly depicts a cross-sectional view of the interaction of the various rotating components. Crank bracket 34 is clamped to the motor shaft through the action of clamp 35. Crank 13 is held within bracket 34 by the clamping action of elastic bands 37 and skid 36. Motor 15 slides along vertical support 16 to adjust the height of obstacle rods 10 and the resulting circular path traversed by rods 10.

The speed of each motor 15 is controlled by a speed controller 15 associated with each motor. As further shown in FIG. 7, one of the motor 15 housings may also include an electronic display that indicates various parameters associated with an exercise routine, such as the time of workout, number of recorded errors, a computed score, etc. The displayed parameters can be used for personal records or for competitive purposes.

Figure 9:
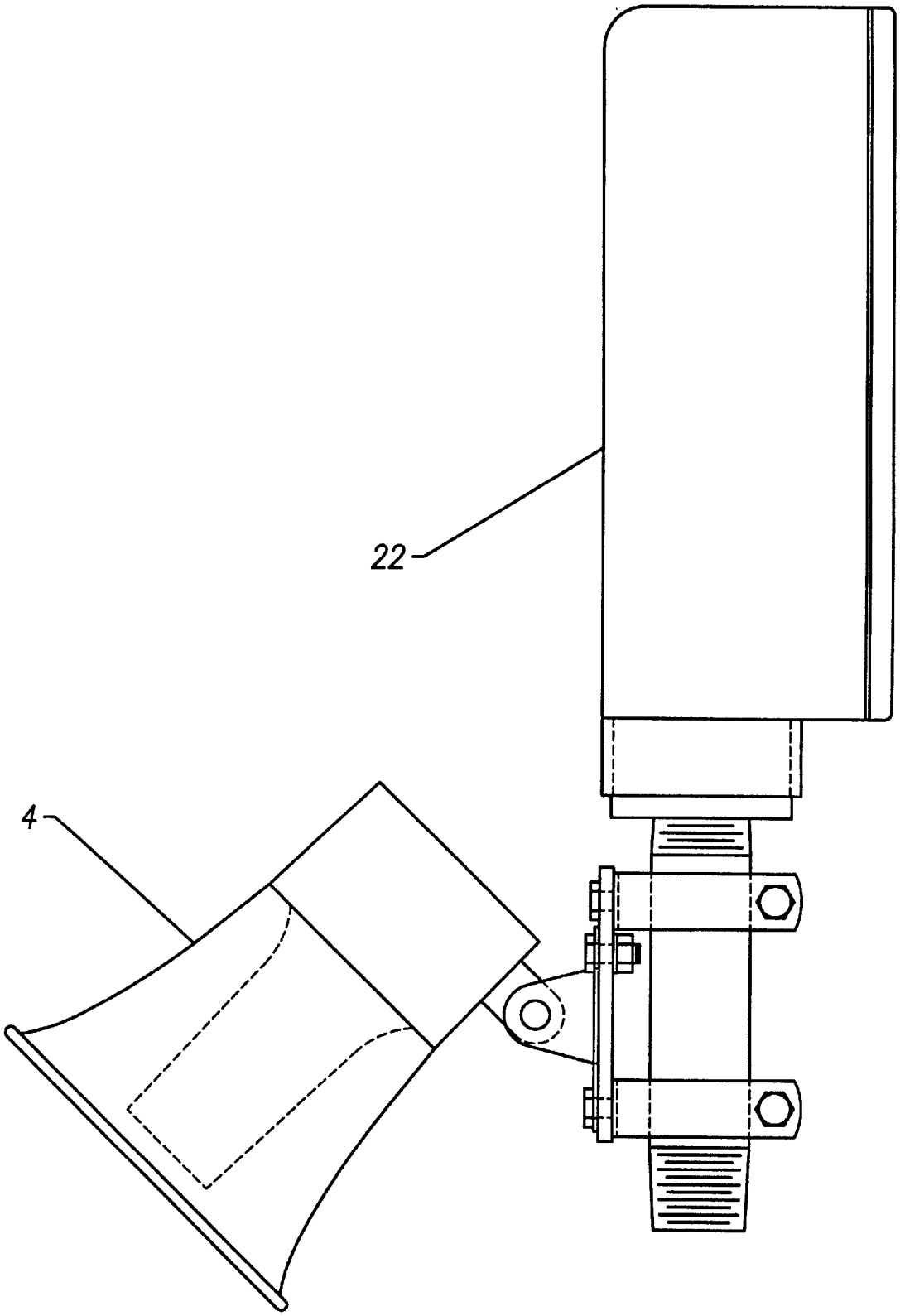
FIGS. 9A–C depict a sensing exercise pad for use in tracking movement of the machine user.
Figure 9A:
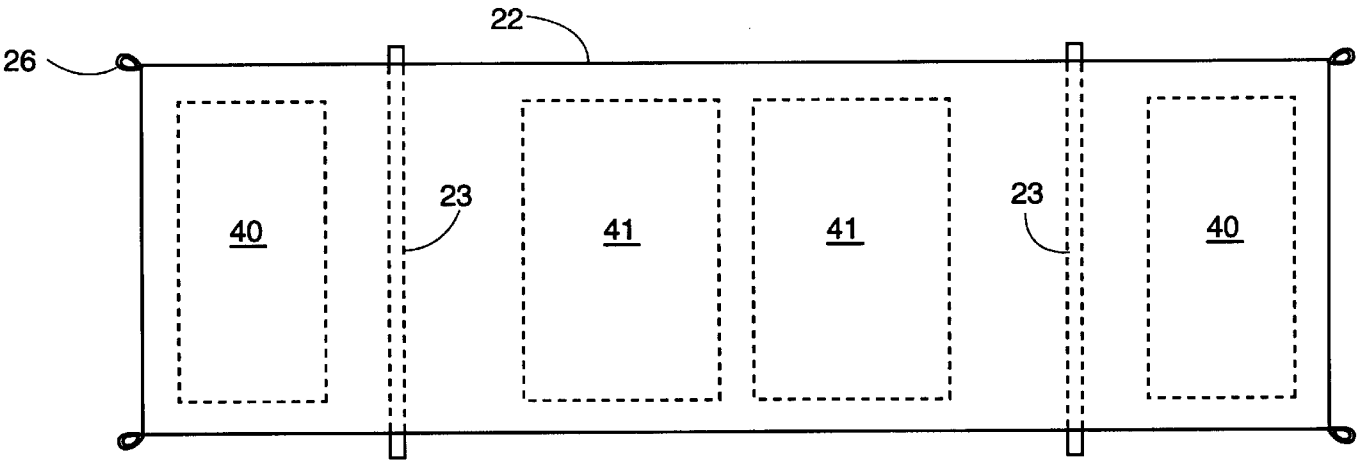
Figure 9B:
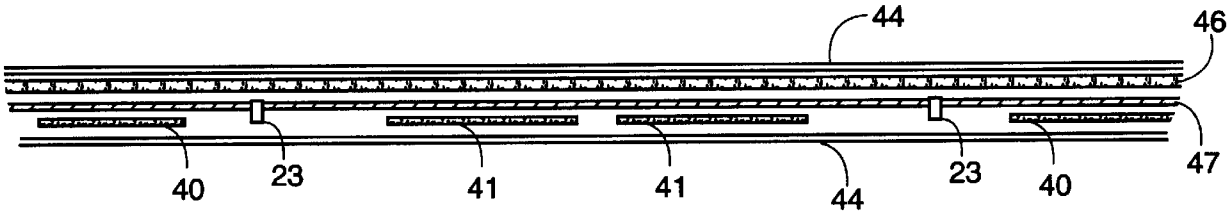
Figure 9C:
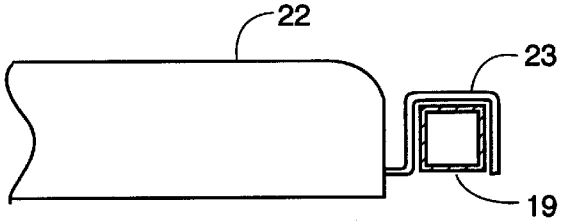

FIGS. 9A–C depict the components of mat 22 that is disposed between legs 19 (FIG. 3). Mat 22 includes fabric or vinyl cover 44, top foam pad 46, and bottom foam pad 47. An exemplary top pad 46 is formed of 170 lb. open cell polyurethane foam. An exemplary bottom pad 47 is formed of high density EVA foam. In accordance with the present invention, mat 22 further includes mat switches 40 that detect when a person crosses from one side of the obstacles rods 10 (FIG. 3) to the another and generate signals for use by electronic display 38 (FIG. 7). Ramps 41 are included to smooth the hump created by base 18 (FIGS. 3 and 4). As discussed in FIG. 3, leg-stabilizing bars 23 have end shapes to engage legs 19 and keep legs 19 from moving from side-to-side. It will be understood that mat switch 40 is electrically connected to display 38 for power and signal transmission. Mat loops 26 are included for use in storing mat 22 on the folded frame assembly (see FIG. 4).

Thus, it can be seen and appreciated that the interactive aerobic exercise machine according to the present invention provides for a variety of operating conditions that challenge both the body and the mind. The speed of rotation of each obstacle rod 10 can be individually adjusted as well as the height of obstacle rods 10. The length of individual cranks 13 can also be individually varied along with the height of horizontal bar 21. This presents a variety of conditions for which solution strategies must be planned and executed.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An interactive aerobic exercise machine, comprising:

a support frame assembly having two parallel, spaced apart vertical frames;

a pair of obstacle rod assemblies comprising a crank and obstacle rod depending therefrom, where each one of said obstacle rod assemblies is rotatably mounted on each one of said vertical frames; and a pair of motors, one of said motors mounted on each one of said vertical frames and attached to each obstacle rod assembly for independently rotating each said obstacle rod at selected rotation speeds and in opposite directions of rotation.

2. An interactive aerobic exercise machine according to claim 1, wherein each said motor is slidably mounted on a vertical frame for independently positioning each one of said obstacle rods at a variety of vertical locations.

3. An interactive aerobic exercise machine according to claim 1, further comprising:

a crank rod connected to each said motor; and a pivot block assembly connecting each said crank rod to a said obstacle rod, where each said pivot block assembly permits a said obstacle rod to move any direction in response to encountering an object and thereafter returns said obstacle rod to a normal position when said object is removed.

4. An interactive aerobic exercise machine according to claim 3, wherein each said pivot block further includes an electrical switch for generating an output signal when a said obstacle rod moves a said pivot block in response to encountering an object.

5. An interactive aerobic exercise machine according to claim 1, further including a mat horizontally placed between said vertical frames, wherein said mat includes end switches at opposite ends of said mat that output an electrical signal whenever a user of said machine activates said end switches.

6. An interactive aerobic exercise machine according to claim 2, further comprising:

a crank rod connected to each said motor; and a pivot block assembly connecting each said crank rod to a said obstacle rod, where each said pivot block assembly permits a said obstacle rod to move any direction in response to encountering an object and thereafter returns said obstacle rod to a normal position when said object is removed.

7. An interactive aerobic exercise machine according to claim 6, wherein each said pivot block further includes an electrical switch for generating an output signal when a said obstacle rod moves a said pivot block in response to encountering an object.

8. An interactive aerobic exercise machine according to claim 2, further including a mat between said vertical frames, wherein said mat includes end switches at opposite ends of said mat that output an electrical signal whenever a user of said machine activates said end switches.

9. An interactive aerobic exercise machine according to claim 8, further comprising:

a crank rod connected to each said motor; and a pivot block assembly connecting each said crank rod to a said obstacle rod, wherein each said pivot block further includes an electrical switch for generating an output signal when a said obstacle rod moves a said pivot block in response to encountering an object.

10. An interactive aerobic exercise machine according to claim 9, further including an electronic display for receiving and displaying said output signals from said pivot block electrical switches and said mat end switches.

* * * * *